United States Patent [19]

Lyall et al.

[11] 4,208,189

[45] Jun. 17, 1980

[54] MATCH SPLINTS AND MATCHES MADE THEREWITH

[75] Inventors: Robert Lyall, Bracknell; Ian Maxwell, Reading; Valerie A. Buckle, Berkshire, all of England

[73] Assignee: Wilkinson Sword Limited, Buckinghamshire, England

[21] Appl. No.: 14,270

[22] Filed: Feb. 23, 1979

[30] Foreign Application Priority Data

Feb. 28, 1978 [GB] United Kingdom ..... 7404/78

[51] Int. Cl.[2] ..... C06F 3/00; C06F 3/02; C06F 5/00

[52] U.S. Cl. ..... 44/42; 44/46; 44/47

[58] Field of Search ..... 44/42–47

[56] References Cited

U.S. PATENT DOCUMENTS

| | | | |
|---|---|---|---|
| 95,730 | 10/1869 | Rogers | 44/42 |
| 101,641 | 4/1870 | Meyer | 44/47 |
| 664,997 | 1/1901 | Fredrikson | 44/46 |
| 2,209,237 | 7/1940 | Simon et al. | 44/42 |
| 2,287,093 | 6/1942 | Ellis | 44/46 |

FOREIGN PATENT DOCUMENTS

| | | | |
|---|---|---|---|
| 1220093 | 1/1971 | United Kingdom | 44/46 |

*Primary Examiner*—Carl F. Dees

*Attorney, Agent, or Firm*—Kane, Dalsimer, Kane, Sullivan and Kurucz

[57] ABSTRACT

A match splint is formed from a rigid core member, which can be substantially non-porous, e.g. of glass, metal or plastic, or porous, e.g. of wood or wood substitute, with an absorbent layer of finely divided particles or fibres adhering to the core adjacent the head of the match, the absorbent layer acting as the reservoir to hold the fuel, e.g. paraffin wax, as an impregnant therein.

6 Claims, 1 Drawing Figure

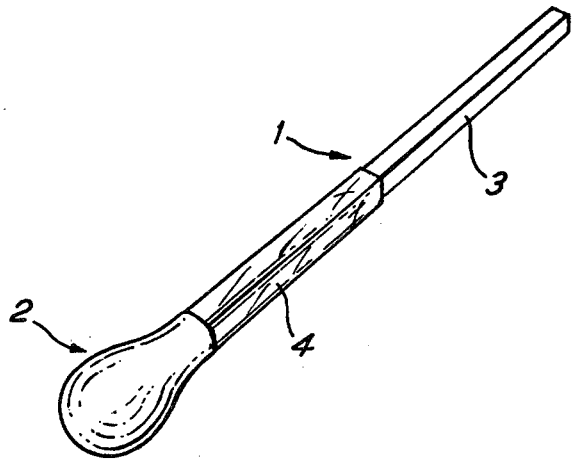
1
2
3
4

MATCH SPLINTS AND MATCHES MADE THEREWITH

BACKGROUND OF THE INVENTION

1. Field of the Invention

This invention relates to splints for matches, and to matches made with splints according to the invention.

2. Brief Description of the Prior Art

Match splints have to meet a number of different requirements in order to be commercially acceptable. For example, they have to be sufficiently rigid to permit the match to be struck whilst holding the match some way away from the match head, they have to have a degree of toughness so that they do not break easily, they have to have sufficient porosity to absorb and retain the wax or other fuel which is used to fuel the flame, and moreover a porosity which permits the fuel to migrate through the pores during the burning process to fuel the flame, but without allowing droplets of fuel to drop from the burning match, and they must also preserve a large measure of their strength and toughness throughout the burning process so that hot or possibly still burning embers do not break or drop off.

Although non-wooden splints have been used and are used extensively in certain special applications, e.g. strips of card, particularly in the so-called book matches, and wax impregnated paper splints, and although many proposals have been made for synthetic or non-wooden splints, wooden splints are still extensively used in the match industry because of their unique combination or rigidity, toughness and porosity. Economic pressures in the timber industry are, however, creating a demand for a cheap substitute for the wooden match splint, a demand which has not so far satisfactorily been met by existing proposals for synthetic or substitute wooden splints.

The various proposals for synthetic or substitute wooden match splints include

- U.S. Pat. Nos. 2,495,575, 2,647,048 and 3,185,552 all of which disclose paper or board splints stiffened by impregnation with resinous or plastics material of various kinds;
- Japanese Patent Publications Nos. 74-21,042, 74-21,043 and 74-21,044 which disclose plastics match splints comprising a plastics binder in combination with various fillers;
- Japanese Patent Publications Nos. 73-38,346 and 74-59,157 which disclose matchsticks formed from a moulded cellulose material;
- U.K Pat. No. 862,932 which discloses match splints composed of an extruded combustible mixture of finely divided vegetable material e.g. paper pulp, wood pulp, sawdust with a synthetic material such as cellulose acetate, with or without additional agglutinants, impregnating agents and fillers; and
- U.K. Pat. No. 882,713 which discloses match splints composed of an outer combustible shell and an inner at least partly combustible core, the shell and the core both being formed from combustible materials such as wood pulp, paper, sawdust, if necessary with an agglutinant such as starch or glue which binds the particulate material together to form a substantially rigid, self-supporting structure.

SUMMARY OF THE INVENTION

The present invention differs from the foregoing proposals in divorcing the functions of rigidity and porosity. Thus, the match splint of the present invention comprises a rigid core or stem, which may be of a combustible or non-combustible material and which may be substantially non-porous, and which extends substantially the length of the match splint, the core or stem having applied over the whole or a portion of its length adjacent one end a layer of finely divided particles or fibres adhering to the surface of the core or stem by means of an adhesive. The adhesive merely serves to hold the finely divided particulate or fibrous material onto the surface of the core as a surface coating thereon and in no way acts to bind these particles or fibres together in a self-supporting structure, thus clearly distinguishing over prior art structures comprising a particular or fibrous material bonded by an agglutinant into a self-supporting composite structure. The layer of finely divided particles or fibres provides a porous surface on the core or stem and acts as a reservoir to hold the wax or other fuel which is used to fuel the flame following striking of the match. Although we do not wish to be bound by any theory it is believed that the particulate or fibrous layer acts to hold the fuel by capillary forces rather than by absorption into the particles or fibres which make up the layer. The particulate or fibrous material used to form the porous layer may be of a combustible or non-combustible material. Preferred are fibrous materials such as comminuted or finely chopped newsprint, cotton, jute, cardboard and finely-chopped synthetic fibres, which form a flocked coating on the surface of the core. Particulate materials e.g. ground peat, sawdust, cereal flours, talc, china clay may be used but are less preferred than the fibrous materials because of low absorbency for the fuel.

BRIEF DESCRIPTION OF THE DRAWING

The accompanying drawing is a view-in-perspective of an embodiment match of the invention.

DETAILED DESCRIPTION OF THE PREFERRED EMBODIMENTS OF THE INVENTION

A wide variety of materials can be used as the core or stem provided that they have the requisite strength and toughness, e.g. wood, glass, metal, plastics. In particular, it may be noted that, since the required porosity is provided by the coating, the core itself may be substantially non-porous, thus permitting the use of a wide range of materials, e.g. metal, glass and plastics, which heretofore have not been usable as match stems because of their substantially non-porous nature. Especially preferred by reason of low cost are composite materials such as chopped newsprint, cotton waste or jute, in admixture with an adhesive or resin binder which can be extruded or otherwise shaped into cores or stems of the appropriate length.

The adhesive may be applied to the core or stem by a variety of techniques, e.g. by spraying, painting or by dipping. The type of adhesive is not critical, although adhesives giving off noxious odours on burning should be avoided. Water-based adhesives such as starch or modified starch adhesives, dextrins and carboxymethylcellulose may be used, or inorganic silicates depending on the material of the core and on the composition of the particles or fibrous material forming the porous and absorbent layer.

Following application of the adhesive, the particular or fibrous coating may be applied by any suitable method known in the art, e.g. by tumbling, electrostatic deposition, or by spraying. Coating weight and thickness will be determined by a number of factors e.g. the dimensions of the core, the type of coating material and the type and amount of fuel which is to be taken up by the coating. On a core or stem of conventional match dimensions, such as, for example a 1.9 mm square coating weights which have been found satisfactory range from 2.3 mg per linear centimeter of the core in the case of chopped or milled cardboard to 9.0 mg per linear centimeter in the case of finely-chopped cotton fibre.

In the case of the preferred flocking agents, i.e. the fibrous materials such as chopped newsprint, cotton rag or jute, fibre lengths may range from 0.1 to 1.0 mm and diameters from 5–80 μm, but these dimensions are not critical. Likewise, the particle size of the particulate materials is not critical and may range from 1–200 μm.

The length of the core or stem covered by the absorbent porous coating will be variable depending on the dimensions of the core itself, the thickness and porosity of the coating itself and the quantity of wax or other fuel that it is desired to absorb into the coating. The coating may extend the whole length of the stem, or only part of the length of the stem e.g. the length of core covered by the coating may be only from 1–2 cm in the case of match stems of conventional length, i.e. 3–4 cms.

Following formation and drying of the porous and absorbent coating on the core, the coating will usually then be impregnated with the fuel, before dipping to form the match head. In certain instances, the formation of the match head and impregnation with the fuel may take place in reverse order.

A variety of solid, low-melting point fuels and liquid fuels may be used, but usually, and as is customary in the art, the fuel of choice will be paraffin wax e.g. of m.p. in the range 45°–70° C. Long chain fatty acids (14–20 carbon atoms) e.g. stearic acid, may also be used, optionally in admixture with paraffin wax. A particularly preferred fuel is a mixture of paraffin wax and stearic acid, since it is found that the presence of such a long chain fatty acid substantially increases the subsequent adhesion of the match head to the splint. Mixture ratios of long chain fatty acid to paraffin wax may range from 10:90 to 90:10, preferably about 50:50. Instead of using a wax/fatty acid mixture to promote head adhesion, the wax impregnated splint may simply be dipped into a bath of molten fatty acid e.g. stearic acid, before dipping to form the match head. For most uses, at least 0.5 cm of the length of the finished match adjacent to the head will be impregnated with the fuel, e.g. the wax, and for most uses, the degree of impregnation will be such that the impregnated outer layer comprises at least 50% by weight of the fuel, e.g. the wax.

Other methods of promoting head adhesion are available, e.g. by roughening the surface of the splint before dipping or by building up the head by a multiple, e.g. double, dipping process.

The wax or other fuel may be applied to the coated core or stem by any suitable technique e.g. by painting or spraying, but most usually and conveniently by dipping. Fuel uptake will vary widely depending on the porosity of the surface coating on the core or stem, the overall dimensions and the type of fuel. For the conventionally sized match splint, e.g. 2.3×2.3 mm in cross-section, fuel uptakes of paraffin wax may suitably range from 5 mg to 40 mg of wax per centimeter of coating length, although excessive loadings of wax should be avoided to avoid drop formation during burning.

Following impregnation with the fuel (or in some cases before) the match head composition may be applied in a conventional manner, such as by dipping. The compositions and techniques for doing this are quite conventional and form no part of this invention. They therefore do not need to be described further.

A typical match incorporating a splint according to this invention is illustrated in the accompanying drawing.

The match comprises a splint 1 according to this invention having a head 2 formed thereon of a conventional match head composition which may either be of the safety or strike anywhere type.

The splint itself comprises a rigid core or stem 3 which extends the length of the splint and the end of which is embedded in the match head composition. The core 3 is of any suitable rigid and tough material, e.g. wood, plastics, glass or a composite material such as sawdust, chopped newsprint, chopped cotton rag, jute or any other waste fibrous material bonded with a suitable bonding agent, e.g. starch or a synthetic plastics resin, and extruded or otherwise shaped to provide a suitably sized core.

A particularly preferred material for the core is a wood substitute composition comprising a blend of hydrophilic and hydrophobic fibres bonded together and orientated along a common axis, in this case, the axis of the match stem, in a matrix of granular starch and a hydrophilic polymer binder and containing in addition up to 6% by weight (dry solids basis) of a cross-linking agent capable of reacting with the starch in an acid catalysed reaction and thereby to insolubilize the starch component of the matrix.

The fibre blend constitutes from 30–80% by weight, dry solids basis, of the total composition with the hydrophilic fibres constituting the major proportion, preferably 90–99.9% by weight of the blend. The preferred fibrous blend is a blend of waste cellulosic fibres such as chopped paper, newsprint, bagasse, straw, sawdust or cotton with synthetic hydrophobic fibres such as polyolefin, polyamide or polyester fibres. The preferred hydrophilic binders are natural polymers such as gluten, zein, casein and soluble starch or solubilized starch derivatives, including mechanically damaged starch granules. Preferred cross-linking agents are formaldehyde and paraformaldehyde in amounts of from 1–3% by weight. The preferred matrix for the fibre blend comprises a granular starch and a natural hydrophilic polymer derived from a common source, preferably from cereal flour or root crop flour.

Adjacent the head end of the match, the surface of the core is coated with a porous or absorbent coating 4 formed by adhering a layer of finely divided particulate or fibrous material to the core. Preferably the coating 4 is a flock of fibrous material, e.g. chopped waste newsprint, cotton rag or jute formed by flocking the fibrous material onto a thin layer of adhesive applied to the stem.

Impregnated into the coating 4 for example, by dipping, is a suitable low-melting point solid or liquid fuel, e.g. paraffin wax.

Matches produced in accordance with this invention have advantages of cheapness as they can be produced largely from waste materials by simple mass production techniques. Moreover by suitable selection of the materials used in the porous coating fuel uptake can be closely controlled to give optimum burning characteristics e.g. height of flame and burning time without detriment to other factors such as rigidity, strength and toughness of the core.

Of course, a variety of additives conventional in the match making art may be added either to the core or to the coating or to the fuel for specific purposes. For example, fire retardants may be incorporated in the core or in the coating to reduce after glow, metal salts can be added to give coloured flames, and dyes or other colourants may be used to colour any or all of the components of the match, and microcrystalline or other waxes or polymers may be added to the paraffin wax or other fuel to modify the properties thereof e.g. viscosity and melting point and hardness, as may be desired.

We claim:

1. In a method for the manufacture of friction matches, which comprises dipping a match splint in a molten wax fuel to provide thereon a wax fuel coating, dipping the match splint, before or after application of the fuel, in a bath of aqueous match head composition, thereby to form thereon a bulb of said match head composition, the improvement which comprises forming a match splint from a substantially non-porous material, applying to the splint, before or after formation of the head and along a portion of the length thereof adjacent that end of the splint on which said head is or is to be formed, a surface coating of an adhesive, applying to that surface coating a layer of finely divided or finely chopped particulate or fibrous material, thereby to form on said substantially non-porous splint an absorbent surface coating of said finely divided or finely chopped particulate or fibrous material, and dipping the coated end of the splint in a molten wax bath, thereby to impregnate the surface coating with said wax.

2. A friction match comprising a substantially non-porous splint having a head of a friction ignitable match head composition formed on one end thereof, and adjacent said head and extending along a portion of the length of the splint an absorbent surface layer comprising a finely divided or finely chopped particulate or fibrous material bonded to the surface of the splint by a layer of adhesive, and impregnated into that absorbent surface layer a solid wax fuel for the match.

3. A match according to claim 2, wherein said layer is formed of a fibrous material selected from chopped or finely comminuted newsprint, paper, cotton, jute, cardboard or a chopped synthetic fibre.

4. A method according to claim 2, wherein the stem or core is composed of a substitute composition comprising a blend of hydrophilic and hydrophobic fibres oriented along the axis of the match splint and bonded together in a matrix of granular starch and a natural or synthetic hydrophilic polymer binder and containing a cross-linking agent capable of reacting in an acid catalyst reaction with the starch component of the matrix.

5. A match according to claim 2, wherein said fuel is paraffin wax.

6. A method according to claim 2, wherein the match head is applied to the splint over said absorbent layer and wherein, in the region of said head, said layer is impregnated with stearic acid to improve the adhesion of said head to the splint.

* * * * *